US009739092B2

(12) United States Patent
Isenhour

(10) Patent No.: US 9,739,092 B2
(45) **Date of Patent: *Aug. 22, 2017**

(54) METHOD AND APPARATUS FOR REAMING WELL BORE SURFACES NEARER THE CENTER OF DRIFT

(71) Applicant: Extreme Technologies, LLC, Vernal, UT (US)

(72) Inventor: James D. Isenhour, Windsor, CO (US)

(73) Assignee: Extreme Technologies, LLC, Vernal, UT (US)

( * ) Notice: Subject to any disclaimer, the term of this patent is extended or adjusted under 35 U.S.C. 154(b) by 443 days.

This patent is subject to a terminal disclaimer.

(21) Appl. No.: 14/298,484

(22) Filed: Jun. 6, 2014

(65) Prior Publication Data

US 2014/0284109 A1 Sep. 25, 2014

Related U.S. Application Data

(63) Continuation of application No. 13/442,316, filed on Apr. 9, 2012, now Pat. No. 8,752,649, and a continuation of application No. 13/517,870, filed on Jun. 14, 2012, now Pat. No. 8,813,877, which is a continuation of application No. 13/441,230, filed on Apr. 6, 2012, now Pat. No. 8,851,205, application No. 14/298,484, which is a continuation of application No. 13/644,218, filed on Oct. 3, 2012, now Pat. No. 9,163,460.

(60) Provisional application No. 61/473,587, filed on Apr. 8, 2011, provisional application No. 61/566,079, filed on Dec. 2, 2011, provisional application No. 61/542,601, filed on Oct. 3, 2011.

(51) Int. Cl.

| | |
|---|---|
| ***E21B 7/28*** | (2006.01) |
| ***E21B 10/42*** | (2006.01) |
| ***E21B 10/26*** | (2006.01) |

(52) U.S. Cl.

CPC ..... *E21B 7/28* (2013.01); *E21B 10/26* (2013.01); *E21B 10/42* (2013.01)

(58) Field of Classification Search

CPC ..... E21B 10/26; E21B 10/42; E21B 7/28

See application file for complete search history.

(56) References Cited

U.S. PATENT DOCUMENTS

| | | | |
|---|---|---|---|
| 1,489,849 | A | 4/1924 | Sidney et al. |
| 1,772,491 | A | 8/1930 | Ernest et al. |
| 3,231,033 | A | 1/1966 | Williams et al. |
| 3,237,705 | A | 3/1966 | Williams et al. |
| 3,575,247 | A | 4/1971 | Feenstra et al. |
| 4,610,307 | A | 9/1986 | Jurgens et al. |
| 4,729,438 | A | 3/1988 | Walker et al. |
| 4,807,708 | A | 2/1989 | Forrest et al. |
| 4,989,681 | A | 2/1991 | Lohmuller et al. |
| 5,186,265 | A | 2/1993 | Henson et al. |
| 5,372,351 | A | 12/1994 | Oliver |
| 5,495,899 | A | 3/1996 | Pastusek et al. |

(Continued)

FOREIGN PATENT DOCUMENTS

| | | |
|---|---|---|
| EP | 219959 | 4/1987 |
| WO | WO2008026011 | 3/2008 |

*Primary Examiner* — Blake Michener

(74) *Attorney, Agent, or Firm* — Remenick PLLC

(57) ABSTRACT

A well bore reaming device and method are disclosed. The device includes a drill string, a bottom eccentric reamer coupled to the drill string, and a top eccentric reamer coupled to the drill string, wherein the bottom and top eccentric reamers have a prearranged spacing and orientation.

40 Claims, 8 Drawing Sheets

(56) References Cited

U.S. PATENT DOCUMENTS

| | | | |
|---|---|---|---|
| 5,497,842 | A | 3/1996 | Pastusek et al. |
| 5,765,653 | A | 6/1998 | Doster et al. |
| 5,957,223 | A | 9/1999 | Doster et al. |
| 5,992,548 | A | 11/1999 | Silva et al. |
| 6,039,130 | A | 3/2000 | Pruet |
| RE36,817 | E | 8/2000 | Pastusek et al. |
| 6,116,356 | A | 9/2000 | Doster et al. |
| 6,213,226 | B1 | 4/2001 | Eppink et al. |
| 6,227,312 | B1 | 5/2001 | Eppink et al. |
| 6,257,279 | B1 | 7/2001 | Peltz |
| 6,386,302 | B1 | 5/2002 | Beaton |
| 6,397,958 | B1 | 6/2002 | Charles et al. |
| 6,488,104 | B1 | 12/2002 | Eppink et al. |
| 6,494,272 | B1 | 12/2002 | Eppink et al. |
| 6,607,371 | B1 | 8/2003 | Raymond et al. |
| 6,609,580 | B2 | 8/2003 | Beaton |
| 6,622,803 | B2 | 9/2003 | Harvey et al. |
| 6,695,080 | B2 | 2/2004 | Presley et al. |
| 6,920,944 | B2 | 7/2005 | Eppink et al. |
| 6,973,974 | B2 | 12/2005 | McLoughlin et al. |
| 6,991,046 | B2 | 1/2006 | Fielder et al. |
| 7,901,137 | B1 | 3/2011 | Peterson |
| 8,752,649 | B2 | 6/2014 | Isenhour |
| 8,813,877 | B1 | 8/2014 | Short, Jr. et al. |
| 8,851,205 | B1 | 10/2014 | Short, Jr. et al. |
| 9,163,460 | B2 | 10/2015 | Isenhour et al. |
| 2002/0056574 | A1 | 5/2002 | Harvey et al. |
| 2002/0125047 | A1 | 9/2002 | Beaton |
| 2002/0166703 | A1 | 11/2002 | Presley et al. |
| 2003/0173114 | A1 | 9/2003 | Presley et al. |
| 2003/0221873 | A1 | 12/2003 | Beaton |
| 2004/0206552 | A1 | 10/2004 | Beaton |
| 2010/0078216 | A1 | 4/2010 | Radford et al. |
| 2010/0089659 | A1 | 4/2010 | Chafai |
| 2010/0116556 | A1 | 5/2010 | Buske |
| 2011/0127044 | A1 | 6/2011 | Radford et al. |
| 2012/0057814 | A1 | 3/2012 | Dadson et al. |
| 2012/0255786 | A1 | 10/2012 | Isenhour |
| 2014/0064646 | A1 | 3/2014 | Meier et al. |
| 2014/0131111 | A1 | 5/2014 | Desmette et al. |

METHOD AND APPARATUS FOR REAMING WELL BORE SURFACES NEARER THE CENTER OF DRIFT

REFERENCE TO RELATED APPLICATIONS

This application is a continuation of U.S. non-provisional application Ser. No. 13/442,316, filed Apr. 9, 2012, entitled "METHOD AND APPARATUS FOR REAMING WELL BORE SURFACES NEARER THE CENTER OF DRIFT," which claims priority to U.S. provisional application Ser. No. 61/473,587, filed Apr. 8, 2011, entitled "METHOD AND APPARATUS FOR REAMING WELL BORE SURFACES NEARER THE CENTER OF DRIFT." This application is a continuation of U.S. non-provisional application Ser. No. 13/517,870, filed Jun. 14, 2012, entitled "METHOD AND APPARATUS FOR REAMING WELL BORE SURFACES NEARER THE CENTER OF DRIFT," which is a continuation of U.S. non-provisional application Ser. No. 13/441,230, filed Apr. 6, 2012, entitled "METHOD AND APPARATUS FOR REAMING WELL BORE SURFACES NEARER THE CENTER OF DRIFT," which claims priority to U.S. provisional application Ser. No. 61/473,587, filed Apr. 8, 2011, entitled "METHOD AND APPARATUS FOR REAMING WELL BORE SURFACES NEARER THE CENTER OF DRIFT." This application is a continuation of U.S. non-provisional application Ser. No. 13/644,218, filed Oct. 3, 2012, entitled "WELLBORE CONDITIONING SYSTEM," which claims priority to U.S. provisional application Ser. Nos. 61/566,079, filed Dec. 3, 2011, and 61/542,601, filed Oct. 3, 2011, both entitled "WELLBORE CONDITIONING SYSTEM." All of which are hereby specifically and entirely incorporated by reference.

BACKGROUND

1. Field of the Invention

The invention is directed to methods and devices for drilling well bores, specifically, the invention is directed to methods and devices for increasing the drift diameter and improving the quality of a well bore.

2. Background of the Invention

Horizontal, directional, S curve, and most vertical wells are drilled with a bit driven by a bent housing downhole mud/air motor, which can be orientated to build or drop angle and can turn right or left. The drill string is orientated to point the bent housing mud/air motor in the desired direction. This is commonly called "sliding". Sliding forces the drill bit to navigate along the desired path, with the rest of the drill string to following.

Repeated correcting of the direction of the well bore causes micro-ledging and "doglegs," inducing friction and drag between the well bore and the bottom hole assembly and drill string. This undesired friction causes several negatives on the drilling process, including but not limited to: increasing torque and drag, ineffective weighting on bit transfer, eccentric wearing on the drill string and BHA, increasing the number of days to drill the well, drill string failures, limiting the distance the well bore can be extended, and issues related to inserting the production string into the well bore.

When a dogleg, spiraled path, or tortuous path is cut by a drill bit, the relatively unobstructed passageway following the center of the well bore may yield a smaller diameter than the well bore itself. This relatively unobstructed passageway is sometimes referred to as the "drift" and the nominal diameter of the passageway is sometimes referred to as the "drift diameter". The "drift" of a passageway is generally formed by well bore surfaces forming the inside radii of curves along the path of the well bore. Passage of pipe or tools through the relatively unobstructed drift of the well bore is sometimes referred to as "drift" or "drifting".

In general, to address these difficulties the drift diameter has been enlarged with conventional reaming techniques by enlarging the diameter of the entire well bore. Such reaming has been completed as an additional step, after drilling of the well bore is completed. Doing so has been necessary to avoid unacceptable increases in torque and drag during drilling. Such additional reaming runs add considerable expense and time to completion of the well. Moreover, conventional reaming techniques frequently do not improve the well bore, but instead simply enlarge certain areas of the well bore.

Accordingly, a need exists for a reamer that reduces the torque and drag on the drill string and produces closer to drift well bore.

A need also exists for a reamer capable of enlarging the diameter of the well bore drift passageway, without needing to enlarge the diameter of the entire well bore.

SUMMARY OF THE INVENTION

The present invention overcomes the problems and disadvantages associated with current strategies, designs and provides new tools and methods of drilling well bores.

One embodiment of the invention is directed to a well bore reaming device. The device comprises a drill string, a bit coupled to the drill string, a bottom hole assembly coupled to the drill string, a bottom eccentric reamer coupled to the drill string, and a top eccentric reamer coupled to the drill string. The bottom and top eccentric reamers are diametrically opposed on the drill string.

In a preferred embodiment, the device further comprises cutting elements coupled to the top eccentric reamer and to the bottom eccentric reamer. Preferably, the cutting elements of the bottom eccentric reamer have a prearranged orientation with respect to the orientation of the cutting elements coupled to the top eccentric reamer. Each eccentric reamer preferably comprises multiple sets of cutting elements. In the preferred embodiment, each set of cutting elements are arranged along a spiral path along the surface of each eccentric reamer. In the preferred embodiment, the device further comprises a flow area adjacent to each set of cutting elements.

Preferably, the bottom eccentric reamer and the top eccentric reamer are spaced at a prearranged position. The outermost radius of the bottom and top eccentric reamers is preferably less than the innermost radius of the well bore and casing. In the preferred embodiment, the bottom eccentric reamer is identical to the top eccentric reamer.

Another embodiment of the invention is directed to a method of reaming a well bore. The method comprises providing a drill string, providing drill bit coupled to the drill string, providing a bottom hole assembly coupled to the drill string, providing bottom eccentric reamer coupled to the drill string, providing top eccentric reamer coupled to the drill string, positioning the top and bottom eccentric reamers at diametrically opposed positions on the drill string, and rotating the drill string in the well bore.

The method preferably further comprises coupling cutting elements to the top eccentric reamer and to the bottom eccentric reamer. The cutting elements coupled to the bottom eccentric reamer preferably have a prearranged orientation with respect to the orientation of the cutting elements coupled to the top eccentric reamer. Preferably, the method further comprises providing each eccentric reamer with multiple sets of cutting elements.

In a preferred embodiment, the method further comprises arranging each set of cutting elements along a spiral path along the surface of each eccentric reamer. Preferably, the method further comprises providing a flow area adjacent to each set of cutting elements. The method, preferably, further comprises spacing the bottom eccentric reamer and the top eccentric reamer at a prearranged spacing and orientation. Preferably the outermost radius of the bottom and top eccentric reamers is less than the innermost radius of the well bore and casing. The first eccentric reamer is preferably identical to the second eccentric reamer.

Other embodiments and advantages of the invention are set forth in part in the description, which follows, and in part, may be obvious from this description, or may be learned from the practice of the invention.

DESCRIPTION OF THE DRAWING

The invention is described in greater detail by way of example only and with reference to the attached drawing, in which.

DESCRIPTION OF THE INVENTION

As embodied and broadly described, the disclosures herein provide detailed embodiments of the invention. However, the disclosed embodiments are merely exemplary of the invention that may be embodied in various and alternative forms. Therefore, there is no intent that specific structural and functional details should be limiting, but rather the intention is that they provide a basis for the claims and as a representative basis for teaching one skilled in the art to variously employ the present invention.

A problem in the art capable of being solved by the embodiments of the present invention is increasing the drift diameter of a well bore. It has been surprisingly discovered that providing diametrically opposed reamers allows for improved reaming of well bores compared to conventional reamers. This is accomplished, in one embodiment, by cutting away material primarily forming surfaces nearer the center of the drift. Doing so reduces applied power, applied torque and resulting drag compared to conventional reamers that cut into all surfaces of the well bore.

Figure 1:
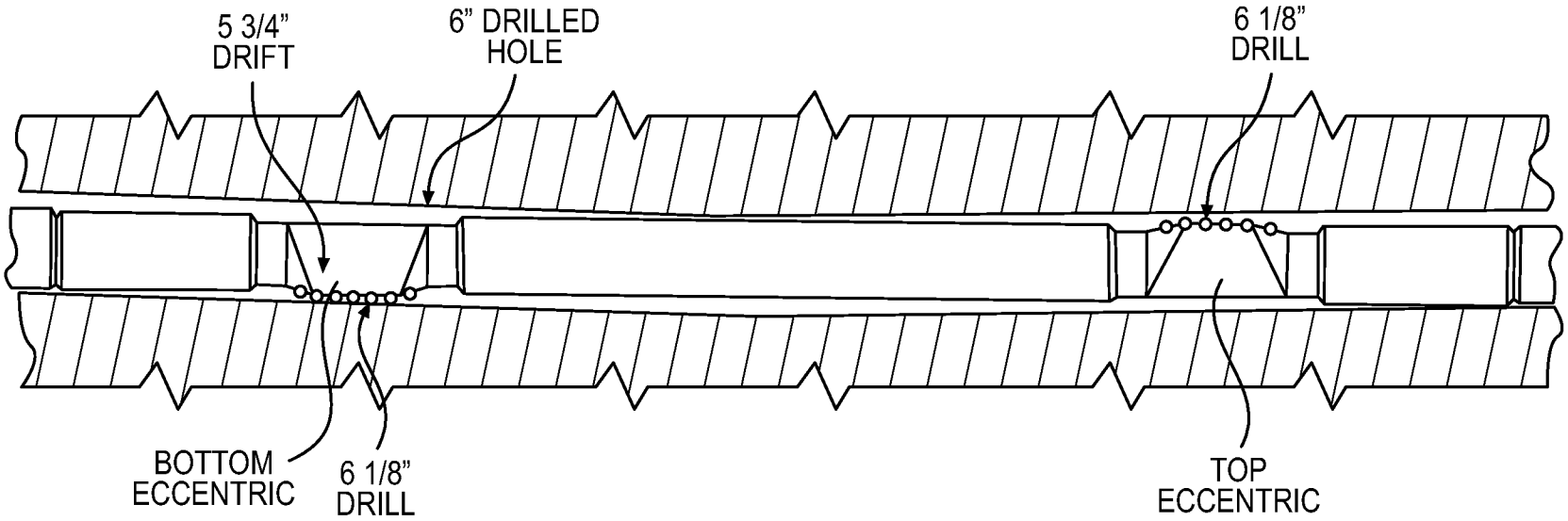
FIG. 1 is a cross-section elevation of a horizontal well bore.

FIG. 1 depicts a cross-sectional view of a horizontal well bore containing a reamer. The reamer has a bottom eccentric reamer and a top eccentric reamer. The top and bottom eccentric reamers are preferably of a similar construction and are preferably diametrically opposed (i.e. at an angular displacement of approximately 180°) on the drill string. However other angular displacements can be used, for example, 120°, 150°, 210°, or 240°. The diametrically opposed positioning causes the cutting elements of each of the top and bottom reamers to face approximately opposite directions. The reamers are spaced apart and positioned to run behind the bottom hole assembly (BHA). In one embodiment, for example, the eccentric reamers are positioned within a range of approximately 100 to 150 feet from the BHA. Although two reamers are shown, a single reamer or a larger number of reamers could be used in the alternative.

As shown, the drill string advances to the left as the well is drilled. Each of the reamers preferably has an outermost radius, generally in the area of its cutting elements, less than the inner radius of the well bore. However, the outermost radius of each reamer is preferably greater than the distance of the nearer surfaces from the center of drift. The top and bottom reamers preferably comprise a number of carbide or diamond cutting elements, with each cutting element preferably having a circular face generally facing the path of movement of the cutting element relative to the well bore as the pipe string rotates and advances down hole.

In FIG. 1, the bottom reamer begins to engage and cut a surface nearer the center of drift off the well bore shown. As will be appreciated, the bottom reamer, when rotated, cuts away portions of the nearer surface of the well bore, while cutting substantially less or none of the surface farther from the center of drift, generally on the opposite side of the well. The top reamer performs a similar function, reamer nearer the center of drift as the drill string advances. Each reamer is preferably spaced from the BHA and any other reamer to allow the centerline of the pipe string adjacent the reamer to be offset from the center of the well bore toward the center of drift or aligned with the center of drift.

Figure 2:
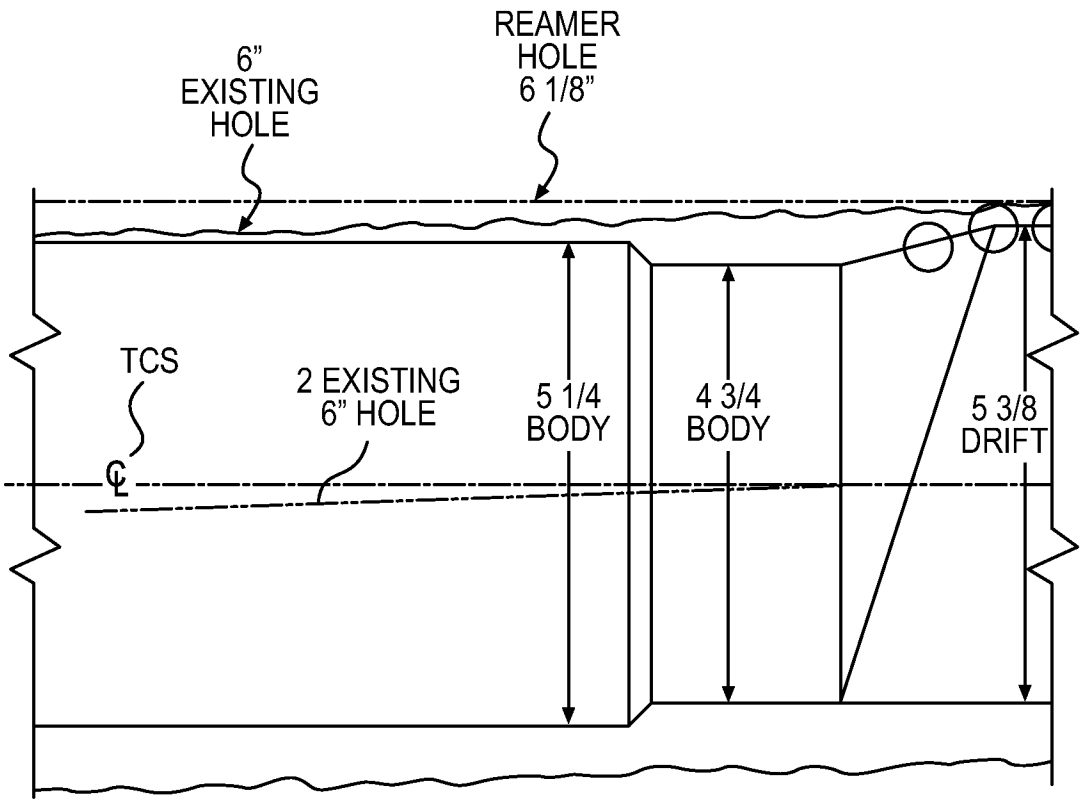
FIG. 2 is a magnification of the down-hole portion of a top reamer.

FIG. 2 is a magnification of the down-hole portion of the top reamer as the reamer advances to begin contact with a surface of the well bore nearer the center of drift. As the reamer advances and rotates, the existing hole is widened along the surface nearer the center of drift, thereby widening the drift diameter of the hole. It will be appreciated that the drill string and reamer advance through the well bore along a path generally following the center of drift and displaced from the center of the existing hole.

Figure 3:
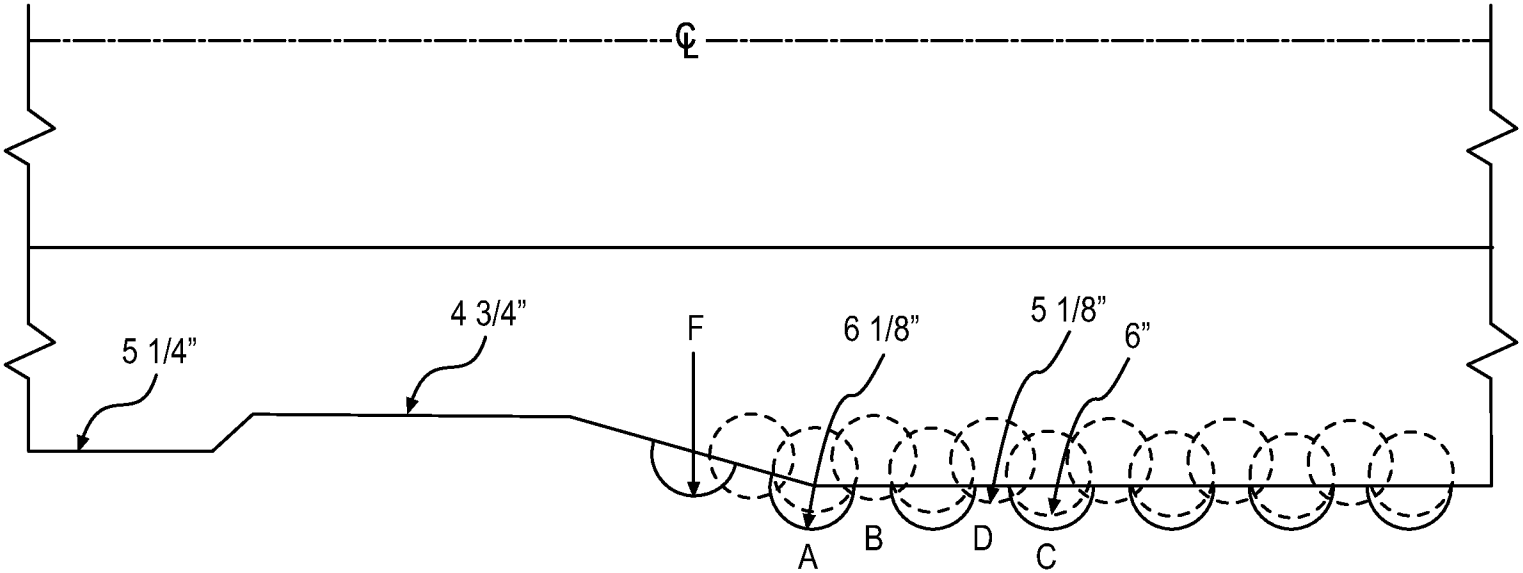
FIG. 3 illustrates the layout of cutting elements along a down-hole portion of the bottom reamer.

FIG. 3 illustrates the layout of cutting structure along a down-hole portion of the bottom reamer illustrated in FIG. 1. Four sets of cutting elements, Sets A, B, C and D, are angularly separated about the exterior of the bottom reamer. FIG. 3 shows the position of the cutting elements of each Set as they pass the bottom-most position shown in FIG. 1 when the bottom reamer rotates. As the reamer rotates, Sets A, B, C and D pass the bottom-most position in succession. The Sets of cutting elements are arranged on a substantially circular surface having a center eccentrically displaced from the center of rotation of the drill string.

Figure 6:
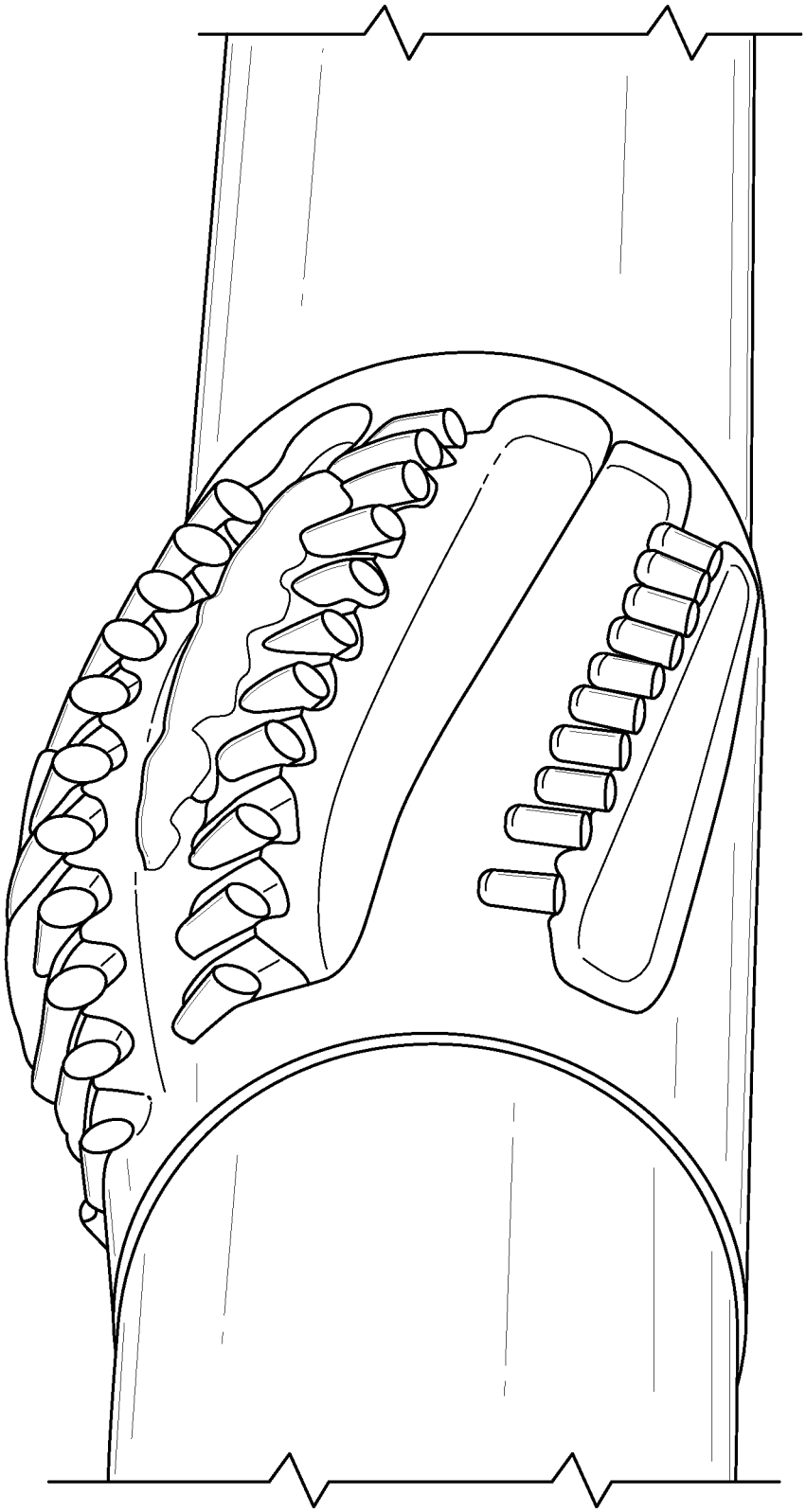
FIG. 6 is an embodiment of a reamer having four sets of cutting elements.

Each of the Sets of cutting elements are preferably arranged along a spiral path along the surface of the bottom reamer, with the down-hole cutting element leading as the reamer rotates (e.g., see FIG. 6). Sets A and B of the reamer cutting elements are positioned to have outermost reamers forming a 6⅛ inch diameter path when the pipe string is rotated. The cutting elements of Set B are preferably positioned to be rotated through the bottom-most point of the bottom reamer between the rotational path of the cutting elements of Set A. The cutting elements of Set C are positioned to have outermost cutting faces forming a six inch diameter when rotated, and are preferably positioned to be rotated through the bottom-most point of the bottom reamer between the rotational path of the cutting elements of Set B. The cutting elements of Set D are positioned to have outermost reamers forming a 5⅞ inch diameter when rotated, and are preferably positioned to be rotated through the bottom-most point of the bottom reamer between the rotational path of the cutting elements of Set C.

Figure 4:
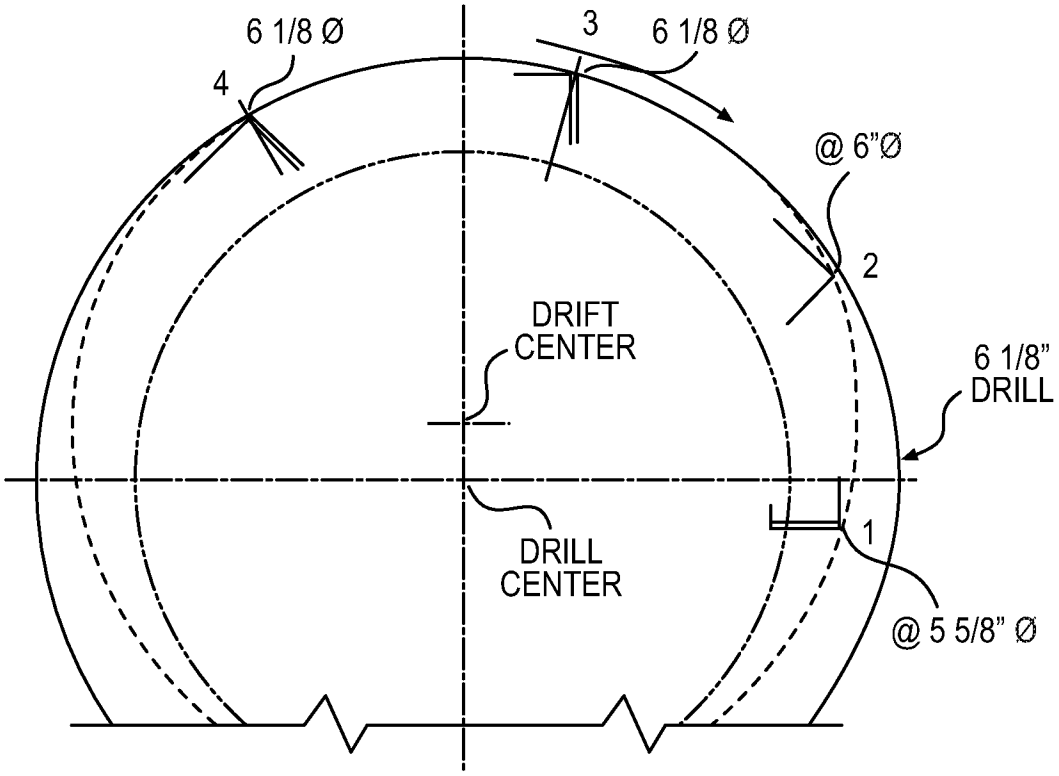
FIGS. 4 and 5 illustrate the location and arrangement of cutting elements on another embodiment of a reamer.
Figure 5:
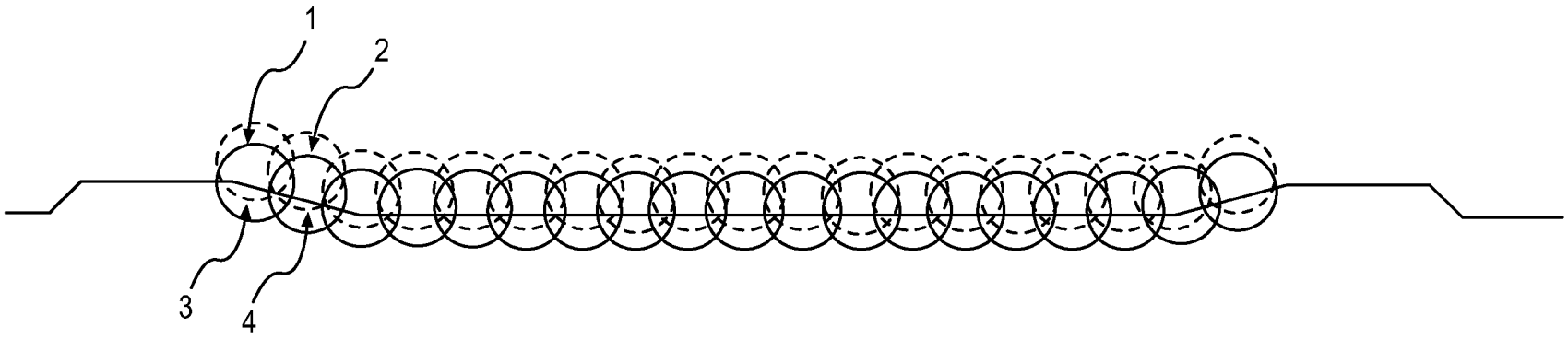

FIGS. 4 and 5 illustrate the location and arrangement of Sets 1, 2, 3 and 4 of cutting elements on another reamer embodiment. Sets 1, 2, 3 and 4 of cutting elements are each arranged to form a path of rotation having respective diameters of 5⅝ inches, 6 inches, 6⅛ inches and 6⅛ inches. FIG. 5 illustrates the relative position of each of Sets 1, 2, 3 and 4 of cutting elements. The cutting elements of Set 2 are preferably positioned to be rotated through the bottom-most point of the reamer between the rotational path of the cutting elements of Set 1. The cutting elements of Set 3 are preferably positioned to be rotated through the bottom-most point of the reamer between the rotational path of the cutting elements of Set 2. The cutting elements of Set 4 are preferably positioned to be rotated through the bottom-most point of the reamer between the rotational path of the cutting elements of Set 3.

FIG. 6 is a photograph illustrating an embodiment of a reamer having four sets of cutting element, with each set arranged in a spiral orientation along a curved surface having a center eccentric with respect to the drill pipe on which the reamer is mounted. Adjacent and in front of each set of cutting elements is a flow area formed in the surface of the reamer. The flow area allow fluids, such as drilling mud for example, and cuttings to flow past the reamer and exit away from the reamer's cutting structure during operation.

The positioning and arrangement of Sets of cutting elements may be rearranged to suit particular applications. For example, the alignment of the Sets of cutting elements relative to the centerline of the drill string, and the distance between the bottom eccentric face and the top eccentric face along with the outer diameter of the reamer body can be adjusted to each application.

Figure 7:
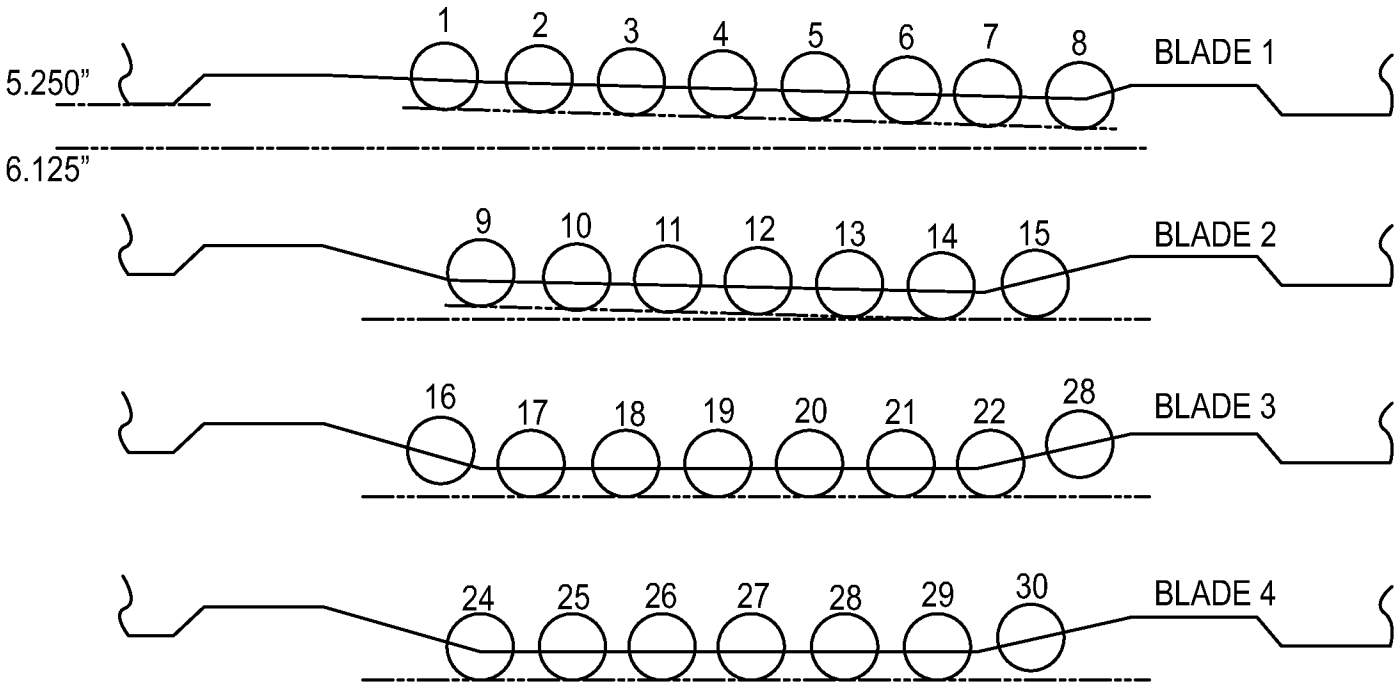
FIG. 7 illustrates the arrangement of cutting elements on each of four blades.

FIG. 7 depicts the blades of an embodiment of a reamer. The reamer is designed to side-ream the "near" side of a directionally near horizontal well bore that is crooked to straighten the crooks. As the 5.25" body of the reamer is pulled into the "near" side of the crook the cut of the rotating reamer will be forced to rotate about the body's threaded center and cut an increasingly larger radius into just the "near" side of the crook without cutting the opposite side. This cutting action will act to straighten the crooked hole without following the original bore hole path.

Figure 8:
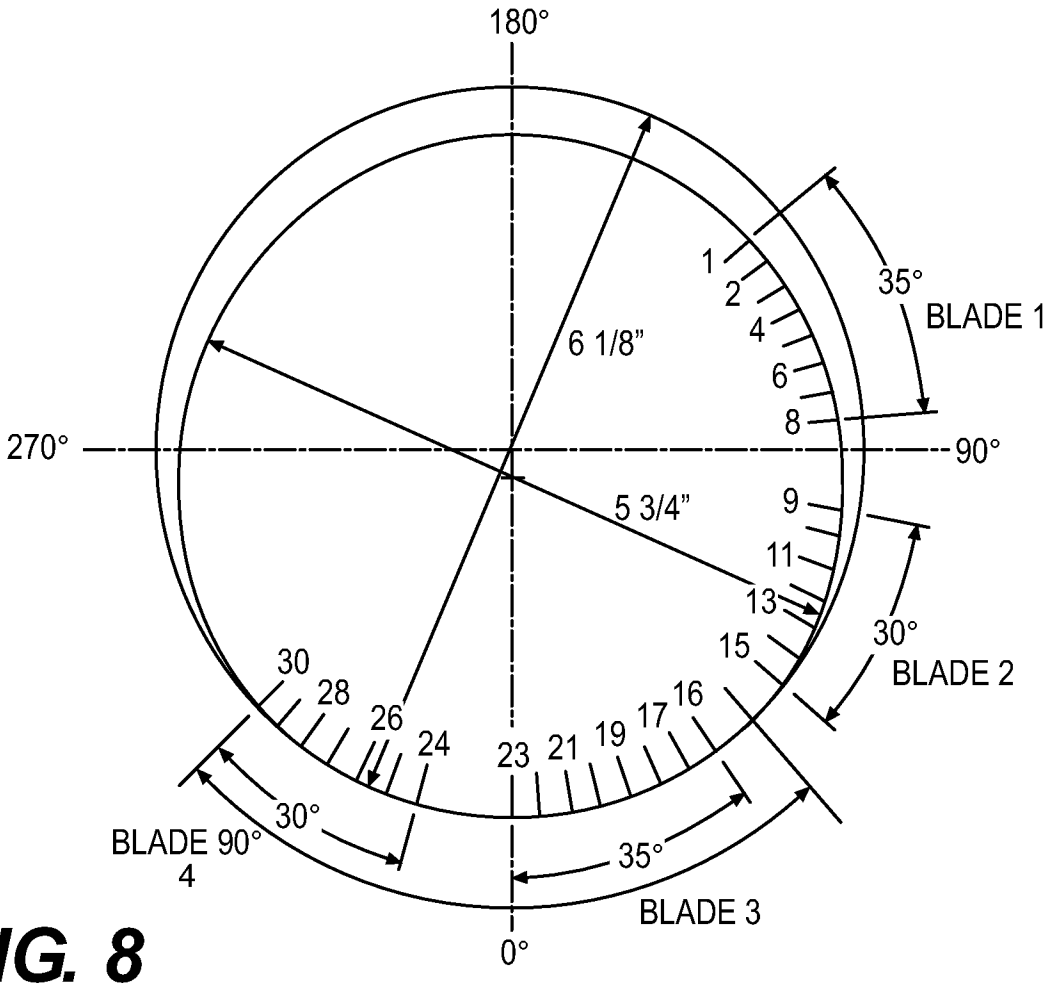
FIG. 8 illustrates the eccentricities of a reamer.

FIG. 8 depicts the radial layout of an embodiment of a reamer. The tops of the PDC cutters in each of the two eccentrics of the reamer rotate about the threaded center of the tool and are placed at increasing radii starting with the No. 1 cutter at 2.750" R. The cutters' radii increase 0.018" ever 5 degrees through cutter No. 17, where the radii become constant at the maximum of 3.062" which is the 6.125" maximum diameter of the tool.

Other embodiments and uses of the invention will be apparent to those skilled in the art from consideration of the specification and practice of the invention disclosed herein. All references cited herein, including all publications, U.S. and foreign patents and patent applications, are specifically and entirely incorporated by reference. It is intended that the specification and examples be considered exemplary only with the true scope and spirit of the invention indicated by the following claims. Furthermore, the term "comprising of" includes the terms "consisting of" and "consisting essentially of."

The invention claimed is:

1. An apparatus for use on a drill string for increasing the drift diameter of a well bore during drilling, comprising:

at least one eccentric reamer positioned on the drill string, wherein each reamer has a plurality of cutting blades extending a distance radially outwardly from the outer surface of the reamer, wherein a first cutting blade extends a first distance, a second cutting blade extends a second distance greater than the first distance, and, in an order counter to the direction of rotation, each additional cutting blade extends an equal or greater distance than the preceding cutting blade, and the plurality of blades defining a curved cutting area extending approximately 50% or less of the circumference of each reamer.

2. The apparatus of claim 1, further comprising grooves disposed between the cutting blades.

3. The apparatus of claim 1, wherein each set of cutting blades is arranged along a spiral path along the surface of the associated reamer.

4. The apparatus of claim 1, further comprising an array of two or more cutting teeth extending from each of the cutting blades and tangentially to each reamer.

5. The apparatus of claim 4, wherein the teeth of each of the plurality of cutting blades of each reamer are offset from the teeth of the adjacent cutting blades.

6. The apparatus of claim 4, wherein each tooth is comprised of carbide or diamond.

7. The apparatus of claim 4, wherein the teeth face the direction of rotation.

8. The apparatus of claim 1, further comprising a coupling adapted to receive a bottom hole assembly.

9. The apparatus of claim 1, wherein the apparatus is positioned behind a drill bit.

10. The apparatus of claim 9, wherein the apparatus is positioned between 100 and 150 feet behind the drill bit.

11. The apparatus of claim 4, wherein the teeth of each of the plurality of cutting blades are longitudinally overlapping from the teeth of the adjacent cutting blades.

12. A well bore drilling device, comprising:

a drill string;

a drill bit positioned at the end of the drill string; and at least one eccentric reamer positioned on the drill string, wherein each reamer has a plurality of cutting blades extending a distance radially outwardly from the outer surface of the reamer, wherein a first cutting blade extends a first distance, a second cutting blade extends a second distance greater than the first distance, and, in an order counter to the direction of rotation, each additional cutting blade extends an equal or greater distance than the preceding cutting blade, and the plurality of blades defining a curved cutting area extending approximately 50% or less of the circumference of each reamer.

13. The device of claim 12, further comprising grooves disposed between the cutting blades.

14. The device of claim 12, wherein each set of cutting blades is arranged along a spiral path along the surface of the associated reamer.

15. The device of claim 12, further comprising an array of two or more cutting teeth extending from each of the cutting blades and tangentially to each reamer.

16. The apparatus of claim 15, wherein the teeth of each of the plurality of cutting blades of each reamer are offset from the teeth of the adjacent cutting blades.

17. The apparatus of claim 15, wherein each tooth is comprised of carbide or diamond.

18. The apparatus of claim 15, wherein the teeth face the direction of rotation.

19. The apparatus of claim 15, wherein the teeth of each of the plurality of cutting blades are longitudinally overlapping from the teeth of the adjacent cutting blades.

20. The apparatus of claim 12, wherein the at least one eccentric reamer is positioned between 100 and 150 feet behind the drill bit.

21. An apparatus for use on a drill string for increasing the drift diameter of a well bore during drilling, comprising:

a pair of eccentric reamers positioned opposingly on the drill string, wherein each reamer has a plurality of cutting blades extending a distance radially outwardly from the outer surface of the reamer, wherein a first cutting blade extends a first distance, a second cutting blade extends a second distance greater than the first distance, and, in an order counter to the direction of rotation, each additional cutting blade extends an equal or greater distance than the preceding cutting blade, and the plurality of blades defining a curved cutting area extending approximately 50% or less of the circumference of each reamer.

22. The apparatus of claim 21, further comprising grooves disposed between the cutting blades.

23. The apparatus of claim 21, wherein each set of cutting blades is arranged along a spiral path along the surface of the associated reamer.

24. The apparatus of claim 21, further comprising an array of two or more cutting teeth extending from each of the cutting blades and tangentially to each reamer.

25. The apparatus of claim 24, wherein the teeth of each of the plurality of cutting blades of each reamer are offset from the teeth of the adjacent cutting blades.

26. The apparatus of claim 24, wherein each tooth is comprised of carbide or diamond.

27. The apparatus of claim 24, wherein the teeth face the direction of rotation.

28. The apparatus of claim 21, further comprising a coupling adapted to receive a bottom hole assembly.

29. The apparatus of claim 21, wherein the apparatus is positioned behind a drill bit.

30. The apparatus of claim 29, wherein the apparatus is positioned between 100 and 150 feet behind the drill bit.

31. The apparatus of claim 29, wherein the teeth of each of the plurality of cutting blades are longitudinally overlapping from the teeth of the adjacent cutting blades.

32. A well bore drilling device, comprising:

a drill string;

a drill bit positioned at the end of the drill string; and a pair of eccentric reamers positioned opposingly on the drill string, wherein each reamer has a plurality of cutting blades extending a distance radially outwardly from the outer surface of the reamer, wherein a first cutting blade extends a first distance, a second cutting blade extends a second distance greater than the first distance, and, in an order counter to the direction of rotation, each additional cutting blade extends an equal or greater distance than the preceding cutting blade, and the plurality of blades defining a curved cutting area extending approximately 50% or less of the circumference of each reamer.

33. The device of claim 32, further comprising grooves disposed between the cutting blades.

34. The device of claim 32, wherein each set of cutting blades is arranged along a spiral path along the surface of the associated reamer.

35. The device of claim 32, further comprising an array of two or more cutting teeth extending from each of the cutting blades and tangentially to each reamer.

36. The apparatus of claim 35, wherein the teeth of each of the plurality of cutting blades of each reamer are offset from the teeth of the adjacent cutting blades.

37. The apparatus of claim 35, wherein each tooth is comprised of carbide or diamond.

38. The apparatus of claim 35, wherein the teeth face the direction of rotation.

39. The apparatus of claim 35, wherein the teeth of each of the plurality of cutting blades are longitudinally overlapping from the teeth of the adjacent cutting blades.

40. The apparatus of claim 32, wherein the pair of eccentric reamers is positioned between 100 and 150 feet behind the drill bit.

* * * * *